United States Patent [19]

Girardin et al.

[11] Patent Number: 5,024,151

[45] Date of Patent: Jun. 18, 1991

[54] REFUSE COMPACTOR

[75] Inventors: Guy Girardin, Ste Foy; Pierre Morin, Sillery; Duy Nguyen; Duc Nguyen, both of St Jean Chrysostome; Louise Brunelle, Charlesbourg ouest, all of Canada

[73] Assignee: Les Enterprises Julien Inc., Quebec, Canada

[21] Appl. No.: 359,439

[22] Filed: May 31, 1989

[51] Int. Cl.[5] ..... B30B 15/14

[52] U.S. Cl. ..... 100/53; 100/229 A; 100/242; 100/255; 100/287

[58] Field of Search ..... 100/229 A, 53, 240, 100/242, 245, 255, 289, 287

[56] References Cited

U.S. PATENT DOCUMENTS

| | | | |
|---|---|---|---|
| 2,400,661 | 5/1946 | Struensee et al. | 100/242 X |
| 3,514,969 | 6/1970 | Harza . | |
| 3,687,068 | 8/1972 | Loughran | 100/255 |
| 3,734,006 | 5/1973 | Hennells | 100/53 |
| 3,748,820 | 7/1973 | Fox | 100/229 AX |
| 3,768,399 | 10/1973 | Martiniak | 100/255 X |
| 3,838,636 | 10/1974 | Engebretsen | 100/229 A |
| 3,853,052 | 12/1974 | Engebretsen | 100/229 A |
| 3,861,117 | 1/1975 | Defilippi | 100/97 X |
| 3,863,561 | 2/1975 | Karls | 100/53 |
| 3,903,790 | 9/1975 | Gladwin | 100/215 |
| 4,084,497 | 4/1978 | Khan | 100/229 AX |
| 4,444,099 | 4/1984 | Paleschuck | 100/229 AX |
| 4,620,479 | 11/1986 | Diamond et al. | 100/215 |
| 4,700,623 | 10/1987 | Durbin et al. | 100/52 |
| 4,719,852 | 1/1988 | Durbin et al. | 100/229 A |
| 4,729,303 | 3/1988 | Durbin | 100/214 |

*Primary Examiner*—Philip R. Coe
*Assistant Examiner*—Stephen F. Gerrity
*Attorney, Agent, or Firm*—Foley & Lardner, Schwartz, Jeffery, Schwaab, Mack, Blumenthal & Evans

[57] ABSTRACT

Disclosed is a refuse compactor particularly designed for aircrafts, which comprises a compaction chamber having a movable wall panel that extends parallel to one of the side wall of the compaction chamber, and can be moved away from this side wall through a very simple mechanism which is operated either directly by a hand-lever or indirectly through the service door of the compactor cabinet when this service door is closed for refuse compaction into a container. In both cases, the very purpose of this lateral motion of the movable wall panel relative to the adjacent side wall is to release the pressure of the refuse container inside the compaction chamber after completion of the compaction, and thus makes this container easily discardable into a storage chamber if any, or out of the compactor. The operation of the movable wall panel is exclusively mechanical and is therefore very simple and reliable.

17 Claims, 13 Drawing Sheets

REFUSE COMPACTOR

BACKGROUND OF THE INVENTION

1. Field of the Invention

The present invention relates to improvements in refuse compactors and more particularly to such compactors as are used in passenger-carrying aircrafts or the like flying vehicles where a relatively large amount of refuse accumulates during flights, rendering space-saving refuse compaction essential.

2. Description of Prior Art

U.S. Pat. No. 4,700,623 of Oct. 20, 1987 discloses a refuse compactor including a compaction ram mounted in a cabinet in which a disposable refuse container may be inserted. The ram is used to occasionally compact refuse that is loaded by the aircraft personnel into the refuse container. To facilitate removal of the container after compaction, one of the side walls of the cabinet is made laterally movable to allow release of the frictional force developed between the refuse container and the cabinet walls during compaction. The operating device which is responsible for driving the ram as well as for moving away the one side wall of the compaction chamber after compaction has been completed to give some slack to the container and thus make its removal easier, is exclusively hydraulic and involves a highly complex control valve system which is not only costly but also requires frequent and appropriate inspection and maintenance to ensure a reliable operation.

U.S. Pat. No. 4,719,852 of Jan. 19, 1988 discloses another refuse compactor in the form of a cabinet defining two aligned and communicating chambers, a front chamber used as a compaction chamber and intended to receive a disposable refuse container, and a rear chamber serving to store the container filled with compacted refuse when the same is moved from the compaction chamber. A door, hinged to a sidewall of the cabinet between the two chambers, is capable of moving from an active position, in which it separates the two chambers, to a retracted position in which it is swung against a sidewall of the storage chamber by a filled refuse container as the latter is pushed into the storage chamber. When in the storage chamber, the stored filled container serves by its front panel as a support wall for the rear panel of a new container to be filled in the compaction chamber.

This refuse compactor is also efficient but has a disadvantage. Indeed, once the filled container is in the storage chamber and when, as aforesaid, its front panel serves as a support wall and is subjected to the pressure applied by the rear panel of a second container under compaction in the front chamber, the side panels of the stored first container are forceably applied against the adjacent walls of the storage chamber. As a result, it is very hard to remove the two containers when both are compactly filled.

Seemingly to avoid the above drawbacks, an alternative embodiment is suggested wherein the storage chamber has a chute, beneath it, into which the filled container in the rear chamber may be dropped for storage. In this manner, the aforesaid hinged door may be repositioned across the two chambers to serve as a support wall for the rear panel of a new container. This solution is only partial as it does not release the pressure of the compacted refuse against the circumscribing panels of the container. Also, it implies the provision of a compactor of a much larger size thereby taking up more valuable aircraft space.

SUMMARY OF THE INVENTION

An object of the present invention is to provide a refuse compactor of the above general type, comprising a compaction chamber having a moveable wall panel that extends parallel to a side wall of the compaction chamber and can be moved away from this side wall through a very simple mechanism which is operated either directly by a hand lever or indirectly through the service door of the compactor cabinet, when this service door is closed for refuse compaction into a container. In both cases, the very purpose of this lateral motion of the movable wall panel relative to the adjacent side wall is essentially to relieve the pressure of the refuse container inside the compaction chamber after completion of the compaction, and thus make this container easily discardable into the storage chamber and/or out of the compactor.

As aforesaid, the operation of the moveable wall is entirely mechanical and manual and therefore very simple and reliable.

Another object of the invention is to provide a refuse compactor of the above mentioned type, having both a compaction and a storage chambers comprising an internal door that can be positioned between the compaction and storage chambers and is capable of resisting the lateral pressure of the rear wall of a container in which refuse is being compacted. The door may consist of a rigid panel that can be detachably fixed to the rear wall of the refuse container before the same is inserted into the compaction chamber and bears against the frame of the compactor when the refuse in the container is being subject to compaction. The door may also be of the foldable garage type so as to be easily moved up into a remote chamber above the storage chamber, in retracted position, and be slid out of the remote chamber into active pressure-resisting position between the compaction and the storage chambers, thanks to appropriate guide means.

Such a compaction pressure-resisting door is much simpler in construction and more reliable in operation than the like door of the prior art apparatus mentioned above.

Yet another object of the invention is in the provision of a new type of locking mechanism for the service door of the compactor as well as a new compacting mechanism located above the compaction chamber. This compacting mechanism is of the pantograph type operated by an electric motor assembly completely independent of the power lifting assembly of the pressure-resisting door vertically movable between the compaction and storage chambers.

More particularly, the invention as broadly claimed hereinafter proposes a refuse compactor comprising a cabinet defining a refuse-compactor chamber and having a front wall and two opposite side walls, and a service door to give access to the compactor chamber through its front wall;

a compaction mechanism mounted in the cabinet above the compaction chamber to compact refuse in a container removeably insertable into the compaction chamber through the service door;

a pressure-resisting wall panel moveably mounted inside the compaction chamber, this wall panel being adjacent and parallel to one of the side walls of the compaction chamber;

cam means mounted inside the compaction chamber, these cam means being capable of laterally moving the wall panel toward and away from the one side wall; and cam means to operate the same in order to reversibly move the wall panel between a first position where the wall panel is rigidly held at a distance from the one side wall of the compaction chamber and a second position where said wall panel extends close to said one side wall.

In accordance with a preferred embodiment of the invention, the compactor further comprises the hinge means connecting the wall panel to the one side wall, the hinge means having axes perpendicular to the front wall and being so designed as to allow the wall panel to move away from the one side wall when the wall panel is shifted upwardly, and move back toward said one side wall when the wall panel is shifted downwardly, the cam means include at least one radially extending cam mounted onto a rotatable shaft fixed under the wall panel; and the actuation means include a hand-operated lever perpendicularly projecting from the shaft to rotate the same, the lever being located in the cabinet close to the front wall thereof and being movable in a plane parallel to the front wall between an horizontal position where it extends flat over the bottom wall and a vertical position where it extends flat over the one side wall, whereby when the lever is in one of the horizontal or vertical positions, each cam on the shaft is engaged under the wall panel and keep it pushed up away from the one side wall and, when the lever is in the other of the positions, each cam is disengaged from under the wall panel which is then free to move down about its hinging means toward the one side wall.

In accordance with another preferred embodiment of the invention, the cabinet has a rigid frame structure and also comprises a storage chamber rearwardly of said compaction chamber, both of said compaction and storage chambers being aligned and in full communication with each other through a large opening, and wherein said compactor further comprises an internal panel detachably fixable to the refuse container prior to inserting the same into the compaction chamber, said internal panel being capable to resist compaction pressure and sized to extend across the large opening and bear against said cabinet frame structure to temporarily provide a pressure-resisting rear wall into the compaction chamber when a refuse container is inserted therein.

Other features and advantages of the invention are revealed in the non-restrictive description that follows of some preferred embodiments of the invention given with reference to the appended drawings.

DESCRIPTION OF PREFERRED EMBODIMENTS

Figure 1:
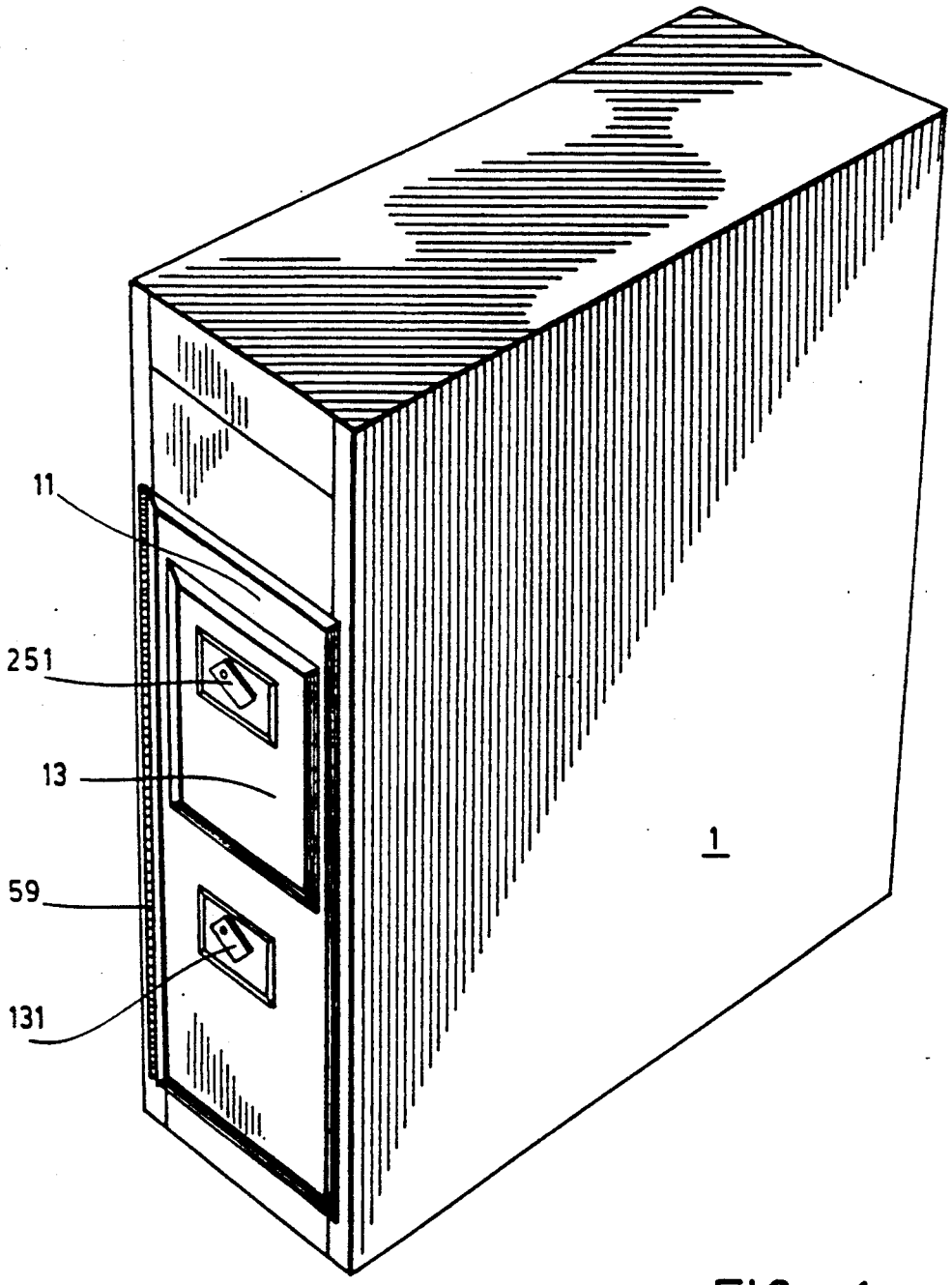
FIG. 1 is a perspective view of a refuse compactor made according to the invention.
Figure 2:
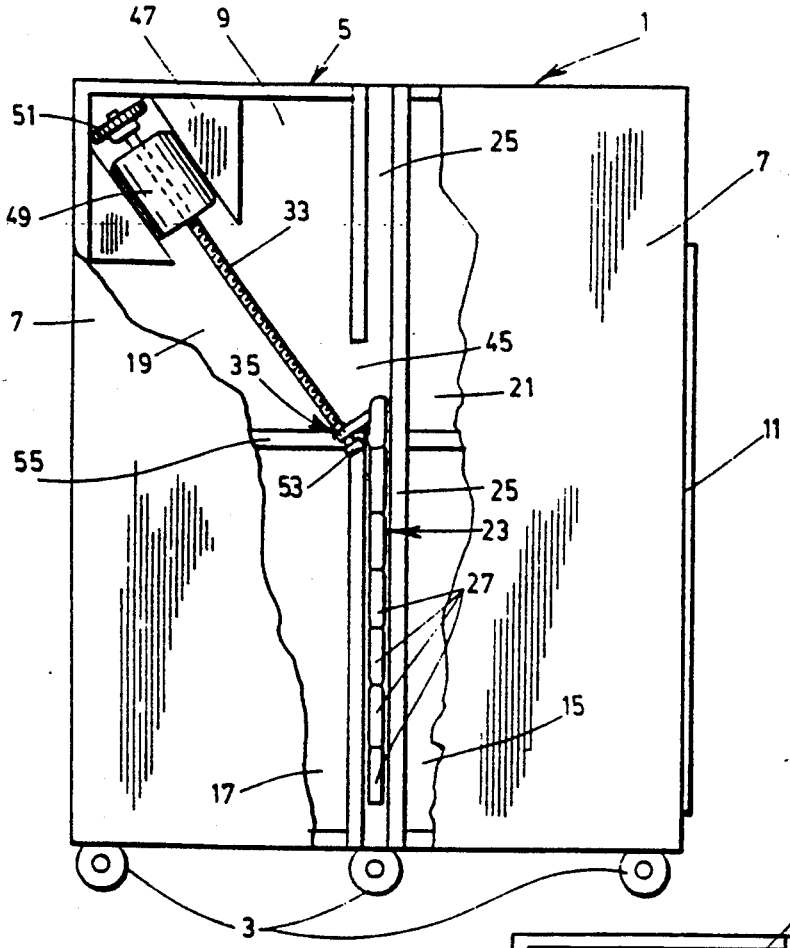
FIG. 2 is a side elevation view partly torn away of a refuse compactor having a garage-type, sliding door, showing the door in active position.
Figure 4:
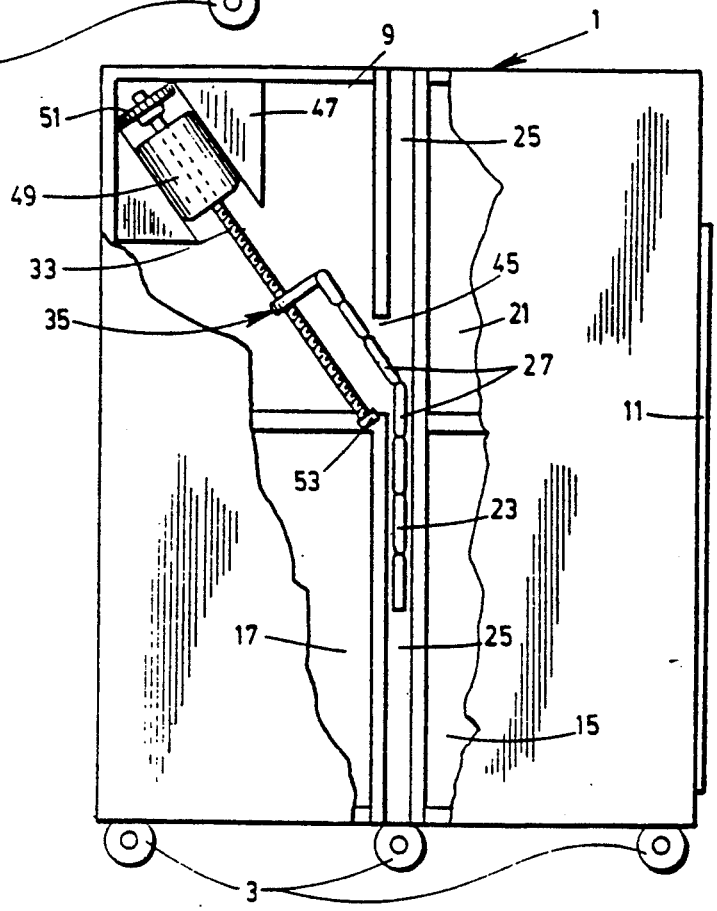
FIG. 4 which appears on the same sheet of drawings as FIG. 2, is a view similar to that in FIG. 2 but with the door in retracted position.
Figure 6:
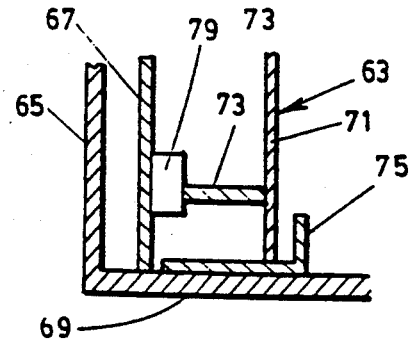
FIG. 6 which appears on the same sheet of drawings as FIG. 3, is a cross-sectional view along line VI—VI of FIG. 5.
Figure 8:
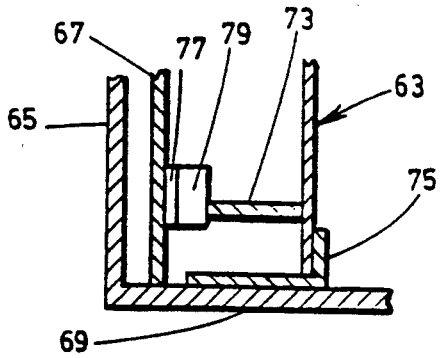
FIG. 8 which appears on the same sheet of drawings as FIG. 6 is a cross-sectional view along line VIII—VIII of FIG. 7.
Figure 3:
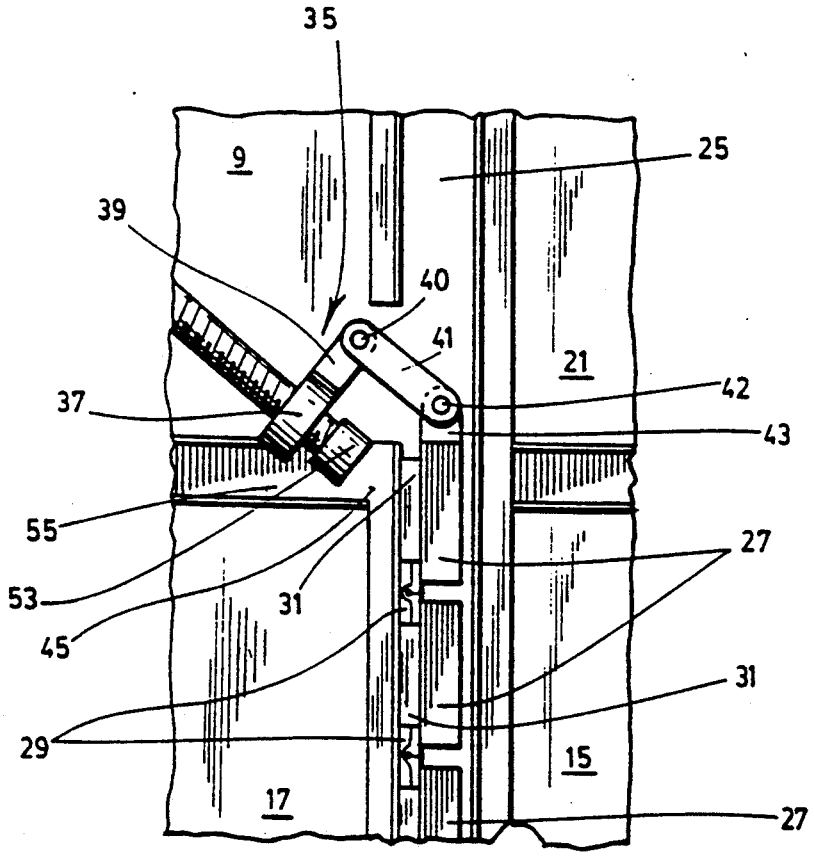
FIG. 3 is an enlarged illustration of the upper part of the sliding door shown in FIG. 2.

The refuse compactor shown in FIGS. 1 to 4 comprises a cabinet 1 mounted on wheels 3 and formed of a framework 5 covered with platings 7, 9, respectively on the inside and on the outside. A service door 11 gives access to the inside for the insertion and withdrawal of refuse containers (not shown). A chute 13, pivoted on the service door 11, serves to introduce refuse into a container within the cabinet. As shown in FIGS. 2 and 4, the latter is divided into a front compaction chamber 15, a rear storage chamber 17, a first remote chamber 19 above the storage chambers 17 and a second remote chamber 21 above the compaction chamber 15. The chambers 15, 17, are aligned and are able to communicate with one another. They may however be separated by a vertically displaceable door 23 built to be capable of resisting pressure applied by the back panel of a container in the compaction chamber 15 when refuse is compacted into it.

The door 23 is guided, in its vertical displacement, between the chambers 15, 17, by means of a pair of inwardly turned vertical channels 25 located on opposite inner lateral faces of the cabinet 1. It is made up of a series of elongated horizontal slats 27 connected together by hinges 29, on their storage chamber side, somewhat like a foldable garage door. In order to provide smooth displacement of the door in the guide channels, the end edges of the slats are lined with TEFLON® strips 31. The door is displaceable between the active position of FIGures and 3 where it closes communication between the chambers 15, 17, and a retracted position, (partially shown in FIG. 4), wherein it lies completely in the remote chamber 19 and the communication between the chambers 15, 17, is established thus allowing discarding of a filled refuse container from the compaction chamber 15 into the storage chamber 17.

Displacement of the door 23 is obtained by means of an inclined rotary screw 33 connected to the top one of the slats 27, at its center, through a lifting strap 35 having one end 37 threaded on the screw and the other end 39 pivoted at 40 to a link 41 which is, in turn, pivoted at 42 to a lug 43 upstanding from the center of the top slat 27, as aforesaid. The foldable door 23 enters into the remote chamber 19 through openings 45 in one of the two flanges of the guide channels 25. As will be gathered, rotation of the screw 33 causes movement of the strap 39 along it and consequently movement of the door 23, through the link 41 connection; the door moving between the active and retracted positions aforesaid.

The screw 33 is rotated by a power assembly mounted on a support bracket 47 fixed to the framework 5. The power assembly comprises an electric motor 49 driving the screw 33 through a speed reducing gear set 51 mounted on the output shaft of the motor 49 and the upper end of the screw 33. The lower end of the screw 33 is mounted on a bearing 53 fixed to framework members 55.

Figure 17:
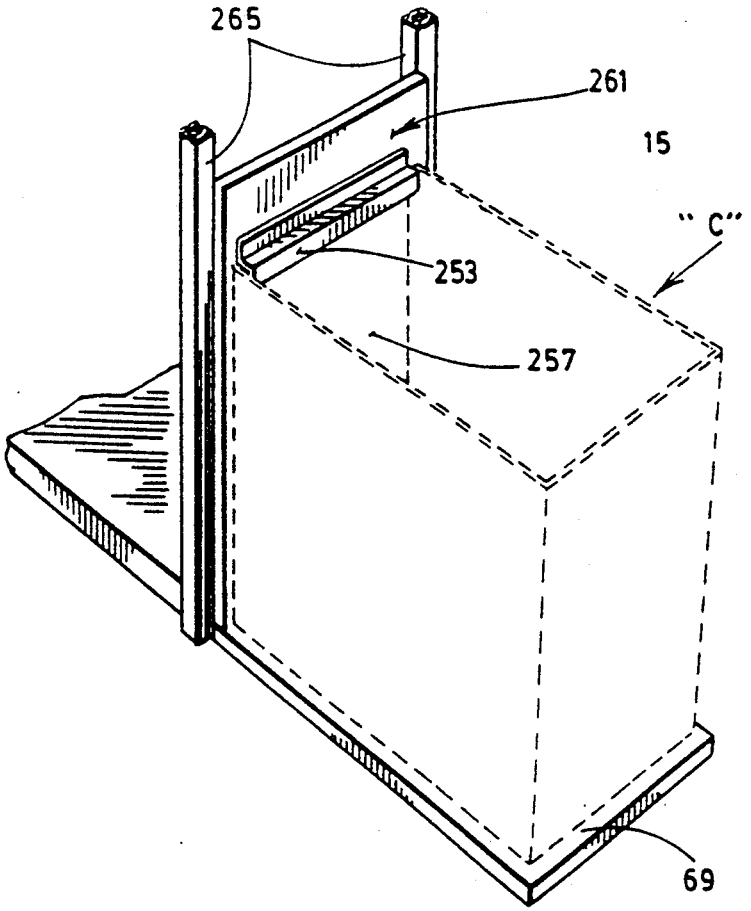
FIG. 17 is a view similar to FIG. 16, showing a refuse container in dolted lines.
Figure 18:
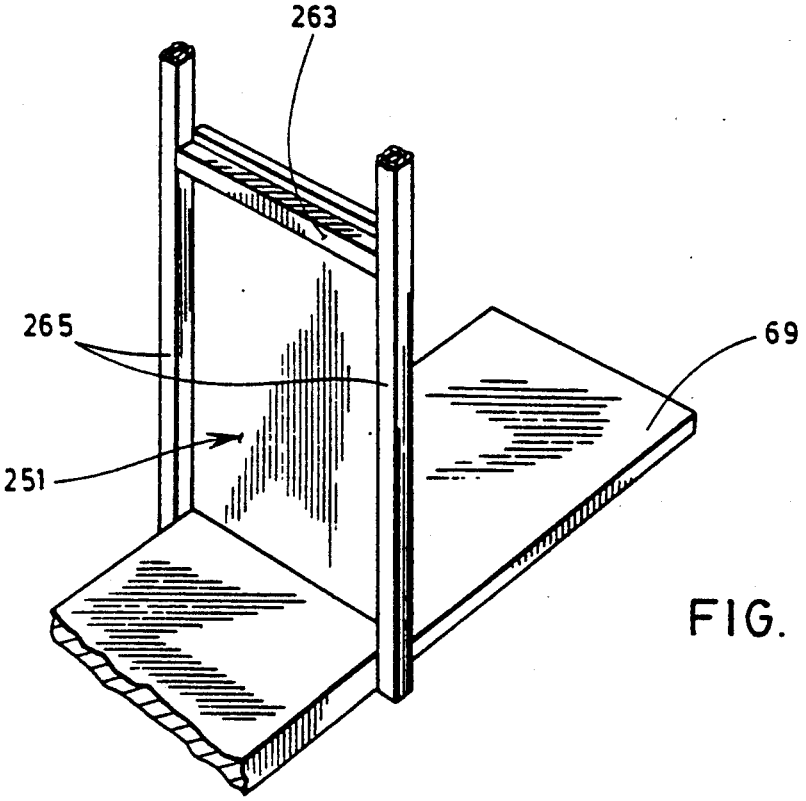
FIG. 18 is another perspective view similar to FIG. 16 but from another angle.
Figure 19:
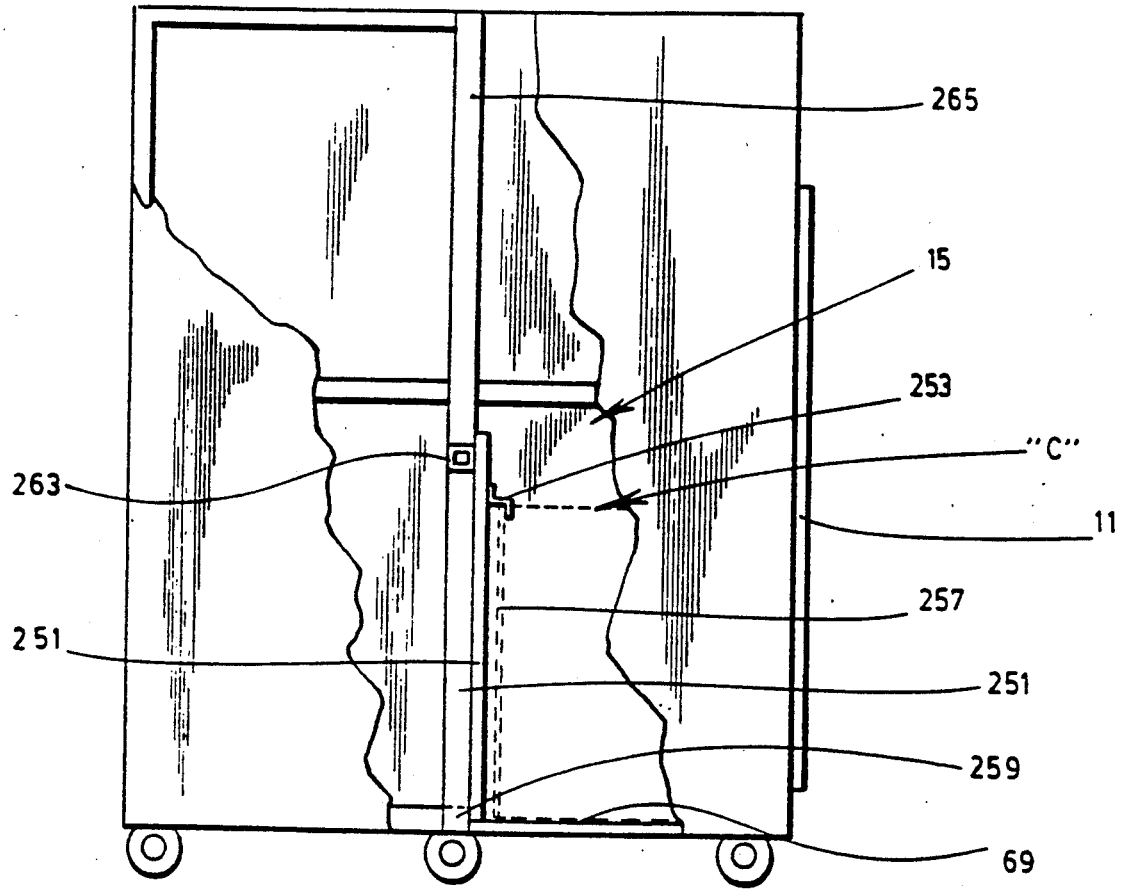
FIG. 19 is a side elevational view partly torn away of a compactor including an internal panel as shown in FIGS. 15 to 18.

Instead of using a sliding door 23 of the garage type as disclosed hereinabove to close the opening between the compaction chamber 15 and the storage chamber 17, use can be made of a small internal panel 251 as is shown in FIGS. 15 to 19, provided on its front wall with an horizontally extending hooking member 253 sized to fit on the top edge of the front wall 257 of the refuse container C (see FIGS. 17 and 19). The panel 251 which is made of steel or any other material capable to resist compaction pressure and is square in shape, is sized to extend across the opening between the chambers 15, 17 and to bear against the cabinet frame structure to temporarily provide a pressure-resisting rear wall into the compaction chamber 15 when the refuse container C is inserted therein. More particularly, the panel 251 is preferably sized to have its lower edge bearing against a small vertical step 259 projecting at the rear of the bottom wall 69 of the compaction chamber 15. The panel 251 is also sized to have its upper edge bearing against a transversal cross-bar 263 forming an integral part of the frame structure of the cabinet. If desired, the panel may also be of such a width that its lateral edges also bear against the vertical studs 265 of the frame structure, to which the transversal cross-bar 263 is fixed.

In use, the internal panel 251 may be hung by means of its holding member 253 onto the front wall 257 of the container C prior to inserting the same into the compaction chamber 15. When the container C is completely inserted into the compaction chamber as it is shown in figs. 17 and 19, the panel 251 comes into contact with the cross-bar 263, the studs 265 and the step 259. In such a position, the panel 251 becomes with a rigid support and holds the front wall of the container C when the refuse therein is subjected to compaction.

When the container C has been compacted, it may be removed out of the compaction chamber through the service door 11 and the internal panel 251 may be removed therefrom and hooked onto another empty container. Of course, all of these steps are manual and must therefore be carried out by the hostesses and/or stewards aboard the aircraft in which the compactor is mounted.

If desired, the compacted container C may be stored into the storage chamber 17. To do so, it may be reinserted into the cabinet after removal of the internal panel, and pushed through the opening in to the storage cabinet 17. To make this pushing easier, small ramps 267 may be provided along the step 259. Of course, corresponding recesses 255 must be provided at the bottom edge of the internal panel 251 to give room to these ramps 267, as clearly shown in FIG. 16.

It must also be appreciated that the spacing between the stud 265 and the spacing between the step 259 and the cross 260 be sufficient to let the compacted container C free to move from the compaction chamber 15 into the storage number 17 when the internal panel 251 is removed therefrom.

Reference will now be made to FIGS. 5 to 8, which show a compactor of the type disclosed hereinabove, provided with a first hand of lateral movable wall.

As is clearly shown in these FIGures, the service door 11 is connected to the front wall 57 of the cabinet 1 by a series of hinges 59 and is able to give access, when opened, to the compaction chamber 15 for the insertion or removal of refuse containers (not shown).

Located parallel to one sidewall 61 of the cabinet 1 is an inner wall panel 63 capable of resisting the pressure created by a side panel of a container into which refuse is compacted.

The sidewall 61 may be constituted, as shown, of an outer plate 65 integrally joined, by the cabinet framework 5, to an inner plate 67. The outer plate 65 is, in turn, fixed to the bottom plate 69 of the cabinet.

The inner wall panel 63 is made up of an inward vertical web 71 and a horizontal flange 73 fixed to the web near its lower end. Angle members 75, secured to the bottom plate 69, limit the inward movement of the wall panel 63.

Cam means consisting of pairs of cooperating wedge blocks 77, 79, cooperate to move the wall panel 63 in a direction perpendicular to the sidewall 61 when it is shifted in a direction parallel to the sidewall by the service door 11 through actuation means to be described hereinafter. The cooperating wedge blocks 77, 79, of each pair are secured, respectively, to the sidewall inner plate 67 and to the free edge of the flange 73 of the wall panel 63.

The actuation means mentioned above includes means connecting the service door 11 to the wall panel 63. These connection means comprise a horizontal shift arm 81, in the form of a threaded bolt, pivoted at 83, at one end, to the adjacent end edge structure of the service door 11 and connected also to the adjacent edge structure of the wall panel 63 in a manner such as to allow shifting of the wall panel toward the storage chamber 17, that is in a direction parallel to the sidewall 61 when the door 11 is being closed and in reverse motion when it is being opened. Because of the cooperating pairs of wedges 77, 79, the wall panel 63 is thus able to move back and forth of the sidewall 61 when the service door 11 is operated.

Figure 7:
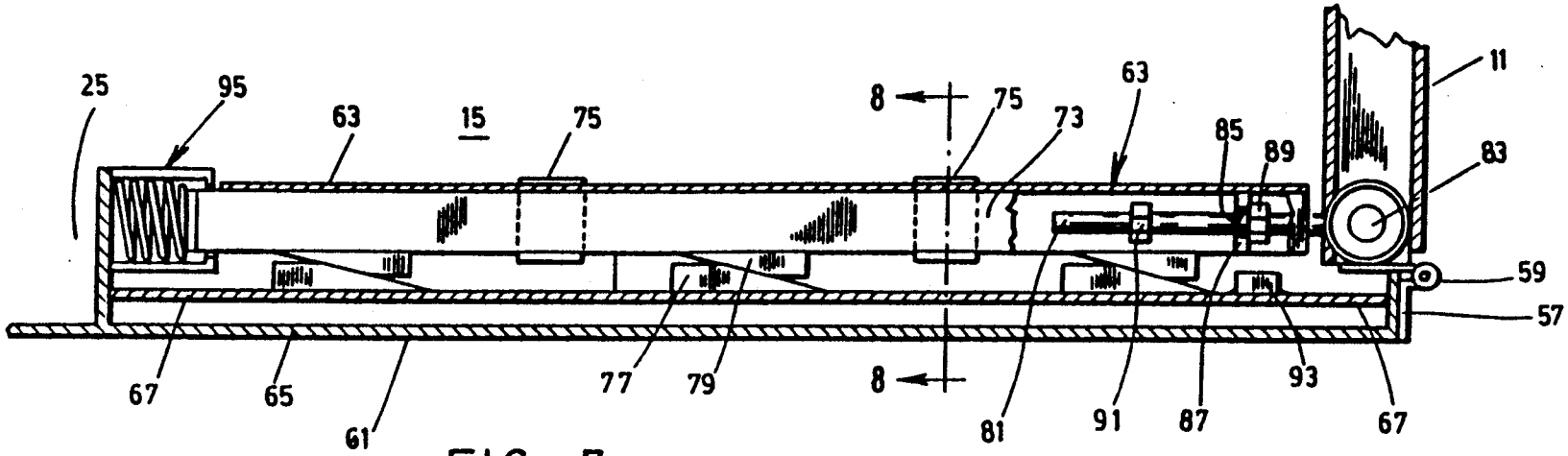
FIG. 7 is a view similar to that of FIG. 5 but with the service door closed.
Figure 5:
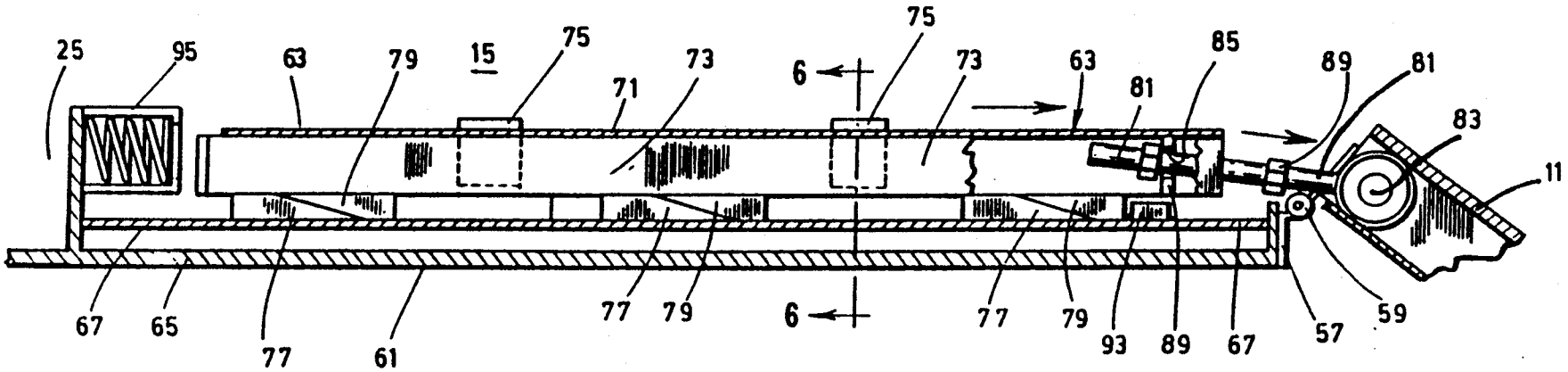
FIG. 5 is a horizontal cross-sectional view through the sidewall of the compaction chamber of a compactor provided with a first type of movable wall with the service door open.

For this purpose, the shift arm or threaded bolt 81 is made to slide through an aperture 85 of a control plate 87 secured to and beneath the flange 73 of the wall panel 63. It is further provided with a pair of stop members in the form of nuts 89, 91, threaded on the bolt 81 on either side of the control plate 87. The distance between these two nuts can therefore be adjusted. Shifting of the wall panel 63 rightward in FIGS. 5 and 7 is limited by a stop block 93 fixed to the inner plate 67 of the sidewall 61. Finally, a return spring structure 95, mounted on a flange of the channel 25 guiding the pressure-resisting door 23, is provided for biassing the wall panel 63 rightward.

With the above arrangement in mind, closing of the service door 11 causes the stop nut 89 to butt against the control plate 87 and to shift the wall panel 63 leftward and against the return spring of the structure 95. Simultaneously, the wall panel 63 moves slightly away from the sidewall 61 through the pairs of wedges 77, 79 and into position to resist the pressure applied when refuse is compacted into a container in the compaction chamber. Once the container is filled, the door 11 is opened which causes the wall panel 63 to be drawn rightward by the stop nut 91 and by the return spring 95. This movement of the wall panel 63 loosens the pressure between it and the refuse container which may then easily be shifted into the storage chamber 17 or removed from the compactor.

An arrangement as described above is also provided of course at the upper ends of the sidewall 61, of the wall panel 63 and of the service door 11 to ensure its parallelism during its displacement.

Figure 20:
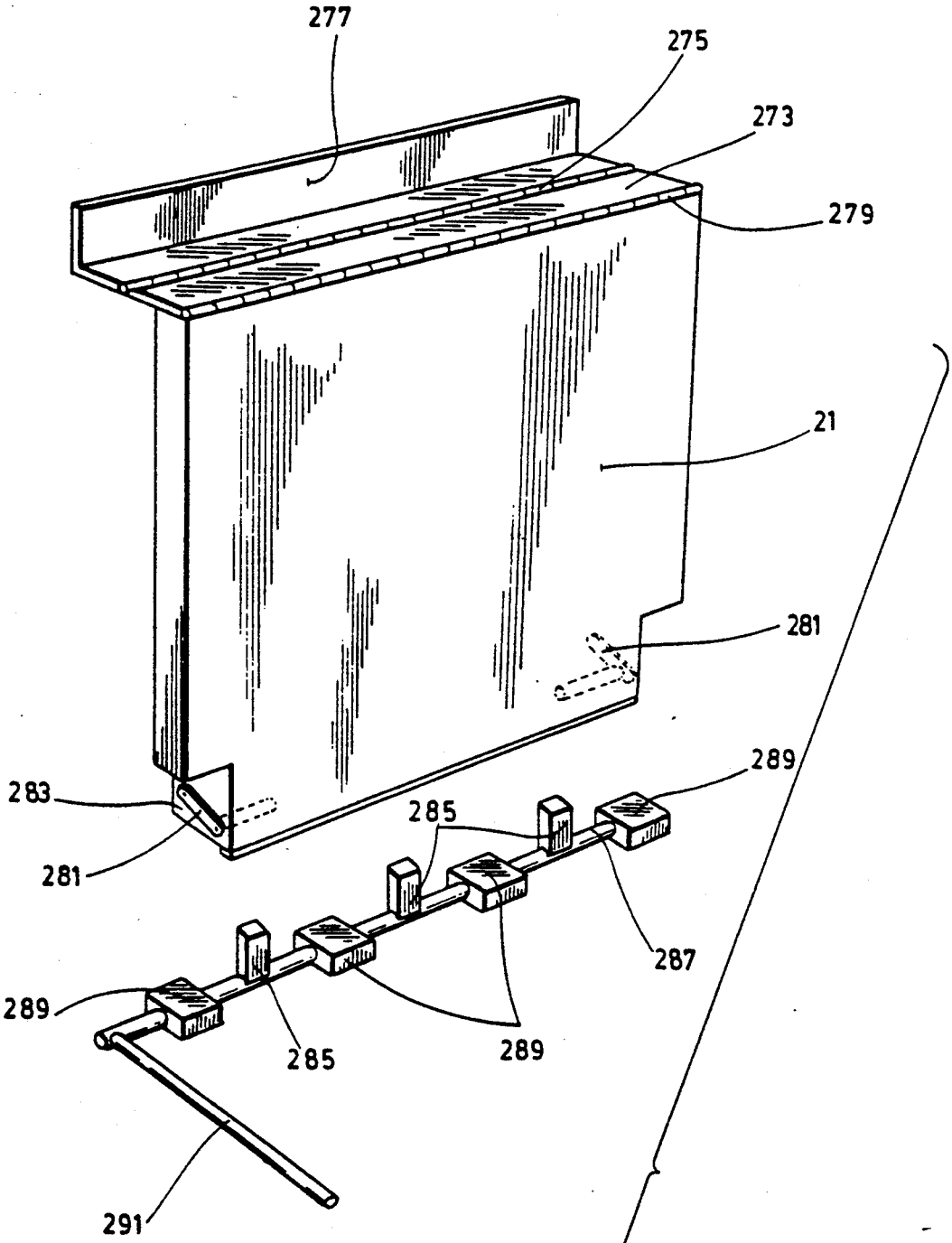
FIG. 20 is a perspective view of another type of movable wall panel.
Figure 21:
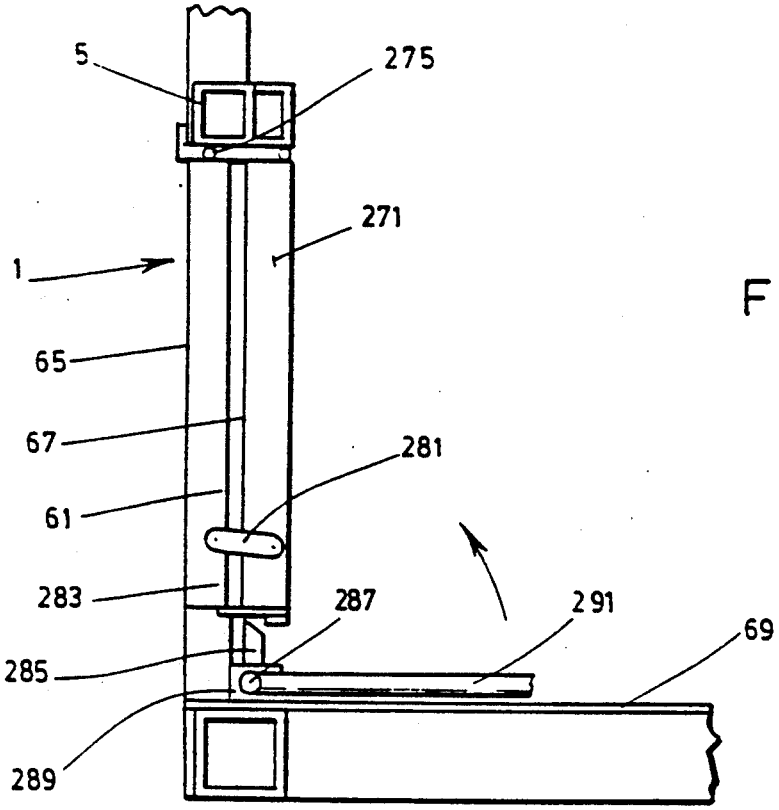
FIG. 21 is a front elevational view of the side wall of a compactor provided with the movable wall panel of FIG. 20 shown in operation position.
Figure 22:
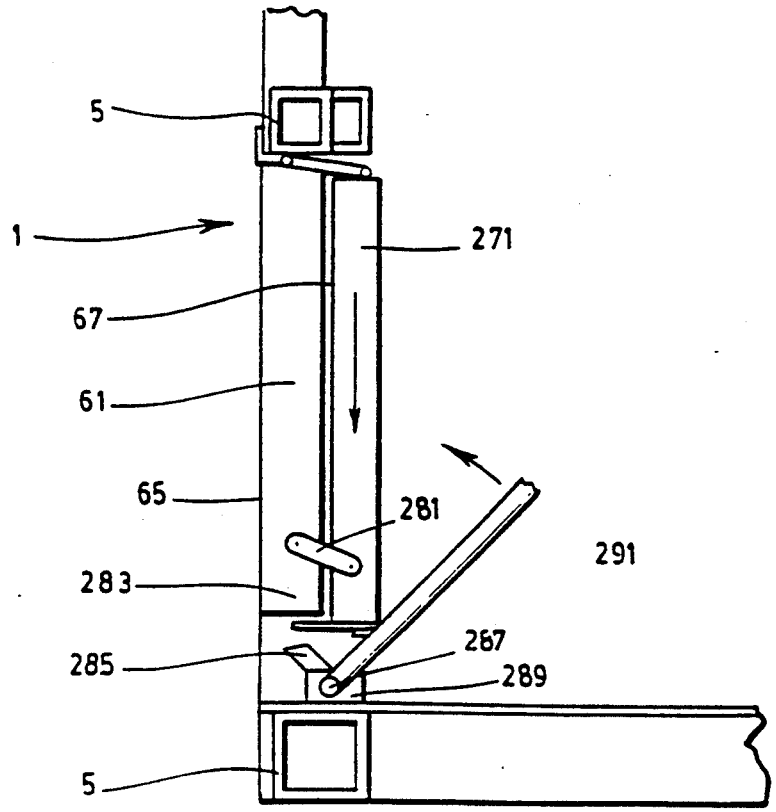
FIG. 22 is a view similar to FIG. 21, showing the movable wall panel in inoperative position.

FIGS. 20 to 22 show a variant of the embodiment that has just been disclosed. More particularly, these figures show a compactor of the type disclosed hereinabove, provided with another kind of lateral, movable wall.

Once again, located parallel to one side wall 61 of the cabinet 1 is an inner wall panel 271 capable of resisting the pressure of the side panel of the container into which refuse is compacted.

As disclosed hereinabove, the side wall 61 may be constituted of an outer plate 65 integrally joined, via the cabinet frame wall 5, to an inner plate 67.

The upper edge of the inner wall panel 271 is connected to the side wall 61 by hinge means consisting of a plate 273 having one edge 275 hinged to an angle member 277 rigidly fixed to the frame 5, and its other edge 279 hinged onto the front top edge of the panel 271.

The lower end of the wall panel 271 is hingedly mounted onto the wall 61 by a pair of pivotable links 281 connected to blocks 283 fixed to the frame 5. All of these hinged means have axes that extend perpendicular to the front wall of the cabinet and thus extend horizontally in directions parallel to the side wall 61 and bottom wall 69.

The hinging plate 273 as well as the links 281 are so designed as to allow the wall panel 271 to move away from the side wall 61 when the wall panel 271 is shifted upwardly (see FIG. 21), and to move back toward the side wall 61 when the wall panel 271 is shifted downwardly (see FIG. 22).

Cam means including a plurality of cams or fingers 285 mounted onto a rotatable shaft 287, are used to shift the wall panel 271 upwardly whenever desired. To do so, the shaft 281 extends longitudinally under the wall panel 271 and is rotatably fixed to the bottom wall 69 of the cabinet by a plurality of pillow blocks 289.

Actuating means are provided to rotate the shaft 289 to push the cams 285 under the wall panel 271 in order to shift it up whenever desired. These actuation means include a hand-operated lever 291 projecting perpendicularly from the shaft 187 to rotate the same. The lever 291 is located in the cabinet close to the front wall thereof in such a manner as to be movable in a plane parallel to this front wall between a horizontal position (see FIGS. 20 and 21) where it extends flat over the bottom wall 69 of the compaction chamber, and a vertical position where it extends flap over the side the side wall 61.

When the lever 291 is in the horizontal position shown in FIG. 2, each cam 285 on the shaft 287 is engaged under the wallpanel 271 and keeps it up and away from the side wall 61. Alternatively, when the lever 291 is moved up as is shown with the arrow in FIG. 22, it moves out of the path of introduction of a container into the compaction compartment and simultaneously causes each cam 285 to disengage from under the wall panel 271 which is then free to move down by gravity about its hinging means and thus go back toward the side wall 61. This movement of the wall panel 271 has the same effect as the movement of the wall panel 63, namely to loosen the pressure between it and the refuse container C which then may be easily removed from the compaction chamber 15 through the service door, or push out of this compaction chamber 15 into the storage chamber 167.

Figure 9:
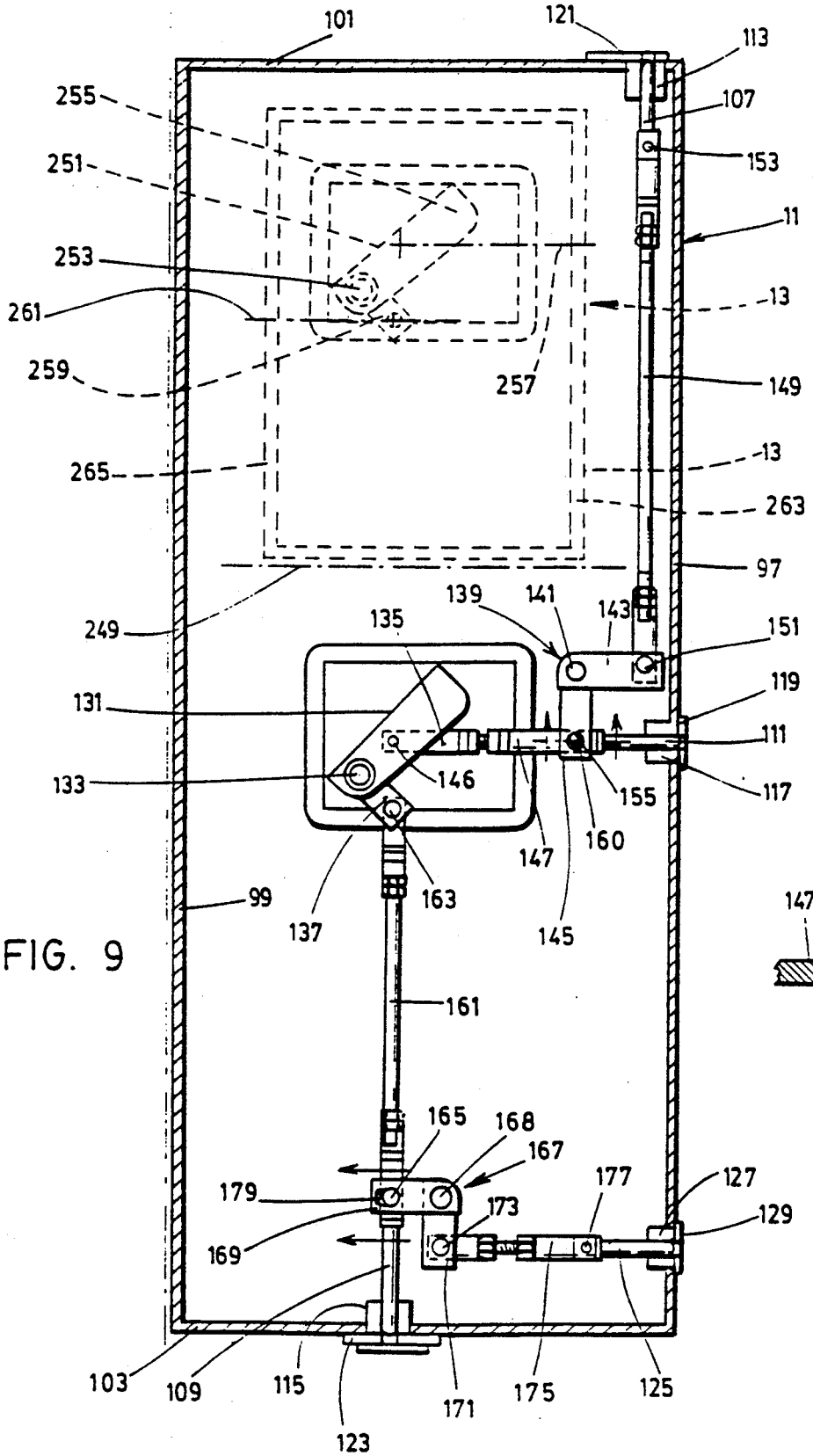
FIG. 9 is a side view of a locking mechanism for the service door in unlocked position.
Figure 11:
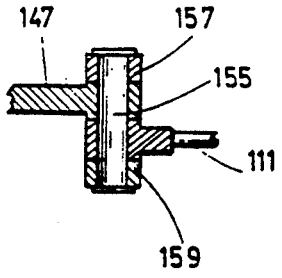
FIG. 11 which appears on the same sheet of drawings as FIG. 9, is a cross-sectional view along line XI—XI of FIG. 9.
Figure 10:
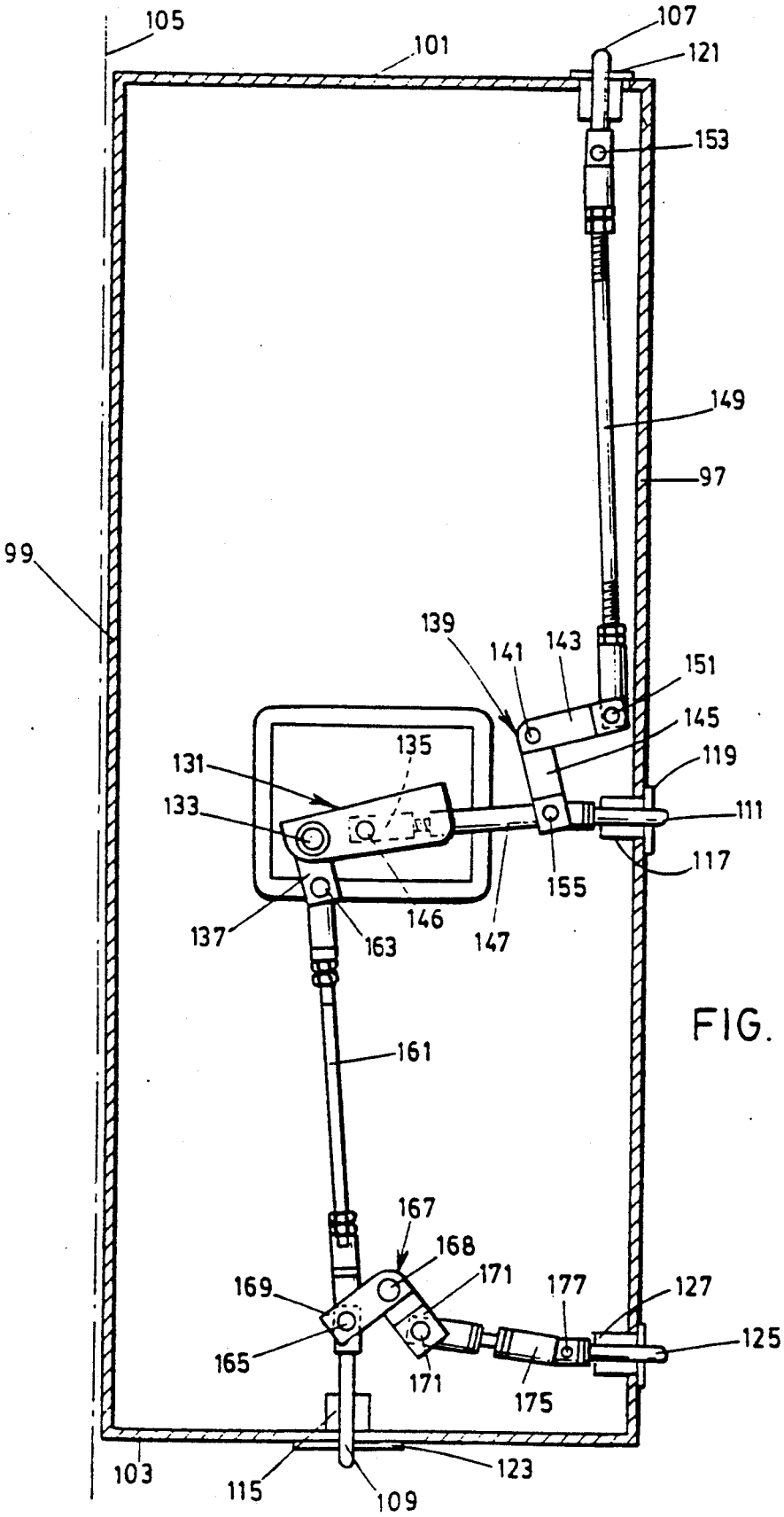
FIG. 10 is a view similar to FIG. 9, showing the locking mechanism in locked position.

FIGS. 9, 10 and 11 show a locking mechanism within the service door 11 for securing it to the cabinet when in closed position. The service door has a central framework of which only the riser members 97, 99, the top member 101 and the bottom member 103 are shown; the left riser member 99 receiving the hinges 59 which allow the door to pivot about the vertical axis 105. The front and back cover plates of the door have also been left out for more clearly showing the locking mechanism.

The latter comprises lock bolts 107, 109, 111 and 125 slidable through the bores of guiding sleeves 113, 115, 117 and 127 respectively fixed to the top member 101, the bottom member 103 and the riser member 97. A stiffening outward plate 123 may also be provided An additional lock bolt 125 is provided below the bolt 111, with its own guide sleeve 127 and stiffening plate 129. As shown, the lock bolts are made to be displaced perpendicularly of the top and bottom members and of the riser member, respectively. They are to be slid simultaneously and between a retracted position within the service door (FIG. 8) and a locking position where they extend partially outwardly (FIG. 10) and into appropriate receiving keepers (not shown) of the cabinet framework. The locking and unlocking operations are achieved by a handle 131, mounted on the door for oscillation about an axis 133 perpendicular to it, and by a linkage assembly connecting the handle 131 and the lock pins 107, 109, 111, 127, and constructed for moving them in unison selectively to the locking and releasing positions.

The locking handle 131 is a right-angular bell-crank lever having a pair of actuating arms 135, 137.

The linkage assembly comprises a first movement-transmitting right-angular bell-crank lever 139 having a pair of transmitting arms 143, 145. It is, like the handle 131, mounted on the service door 11 for oscillation about an axis 141 perpendicular to it. a first rod 147, adjustable as to length by a central conventional nut-and-bolt arrangement, is pivoted at its ends respectively to the movement-transmitting arm 145 (FIG. 9), in knuckle joint manner, and at 146 to the actuating arm 135 of the handle 131. A second rod 149, also adjustable as to length, is pivoted at 151 to the other movement-transmissing arm 143 of the first lever 139 and at 153 to a flattened inward end of the upper lock bolt 107. Likewise, a flattened inward end of the lock bolt 111 (see FIG. 9) is pivoted to both the first rod 147 and the movement-transmitting arm 145 through a common pin 155 (see also FIG. 11). Since the bolt 111 must move at right angle to the riser member 97, and the first bell-crank lever 139 moves angularly, it is obvious that the bell-crank legs 157, 159, of the joint of FIG. 10, must be provided with slightly elongated through slots 160 to accommodate the movement of the common pin 155. Finally, a third rod 161 is pivoted, at 163, to the actuating arm 137 of the handle 131 and also pivoted, at 165, to a flattened inner end of the bottom lock bolt 109. Where the optional lock bolt 125 is used, a second bell-crank lever 167, pivoted at 168 to the door 11, having movement-transmitting arms 169, 171, and identical to the first lever 139, must be used. Its arm 169 is connected, in knuckle-joint manner as in FIG. 9, to the third rod 161 and its arm 171 is pivoted at 173 to a fourth length-adjustable rod 175 of which the other end is pivoted, at 177, to a flattened inner end of the lock bolt 125. Here again, an elongated slot 179 must be foreseen through the two spaced legs of the movement-transmitting arm 167, as in the joint of FIG. 9 and for the same reason.

Regarding the previously mentioned chute 13, shown in FIG. 1 and also in dotted lines in FIG. 9 above the door locking mechanism of the service door 11, it is built in the door 11 for movement through not shown hinges, allowing it to pivot about a horizontal axis 249. Its locking mechanism is quite similar to that just described above with regard to the door 11. It has a bell-crank handle 251 pivoted at 253 at its apex. One actuating arm 255 drives a locking pin linearly through a first rod, such as rod 147, so that the locking pin extends along the horizontal axis 257. As to the other actuating arm 259, it drives a second locking pin, again through a rod such as rod 147, so that the locking pin moves along the horizontal axis 261. The locking pins pass through the riser members 263, 265, respectively, of the chute framework to be lodged into keepers (not shown) of the framework of the service door 11.

As shown in FIG. 9 and 11, when the handle 131 is moved clockwise, its actuating arm 135 pushes on the first rod 147 which tilts slightly downwardly while moving the lock bolt 111 outward through the common pivot pin 155. The pin 155 also rotates the first lever 139 slightly counterclockwise causing the second rod 149 to move, through the pivot 153, the upper lock rod outward. At the same time, the other handle actuating arm 137 shifts the third rod 161 angularly but also downwardly causing, through the pivot pin 165, the lower lock bolt 109 to move outwardly. Simultaneously, the pivot pin 165 rocks the second lever 167 counterclockwise, forcing the fourth rod 175 rightward through the pivot 173 and moving the lock pin 125 out of the door.

Figure 13:
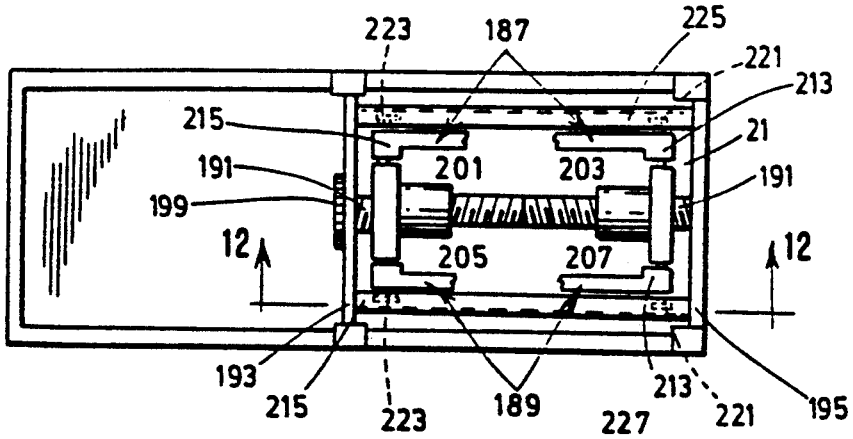
FIG. 13 is a top plan view of the mechanism shown in FIG. 12.
Figure 12:
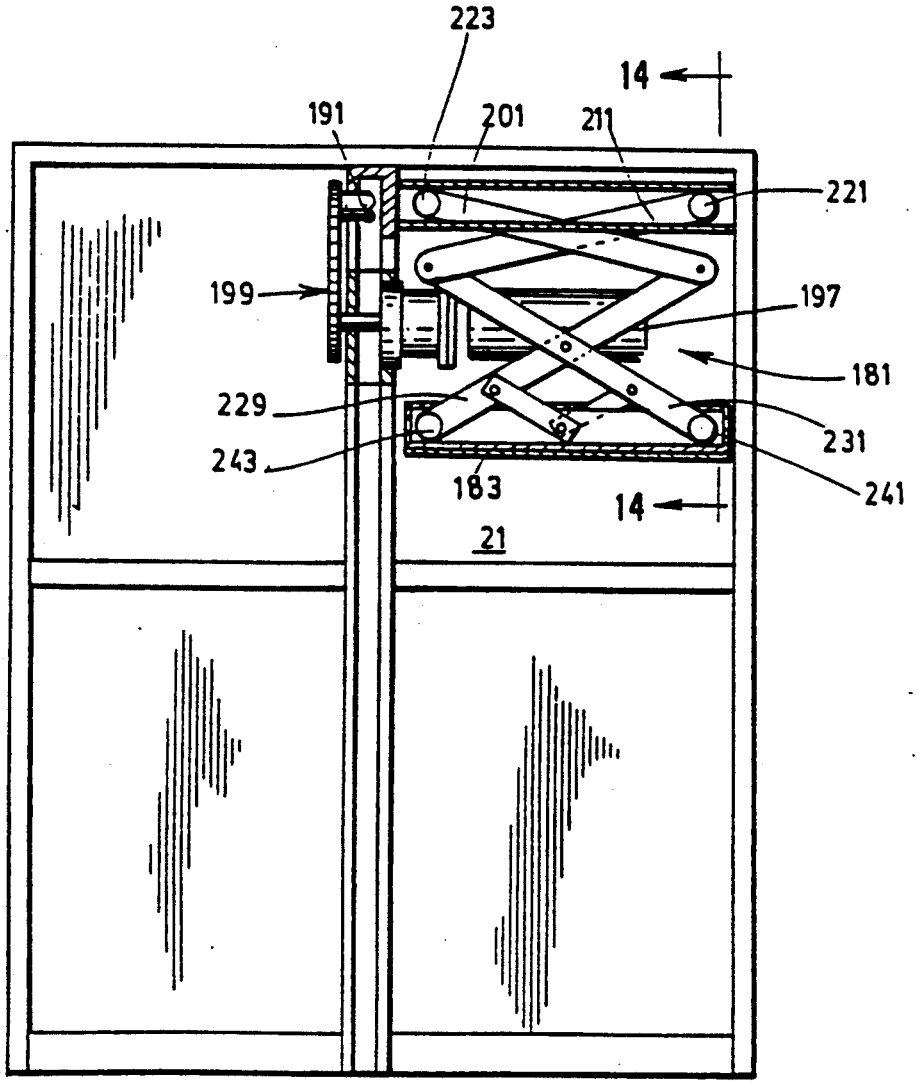
FIG. 12 is a side view of a refuse compacting mechanism taken along line XII—XII of FIG. 13.
Figure 14:
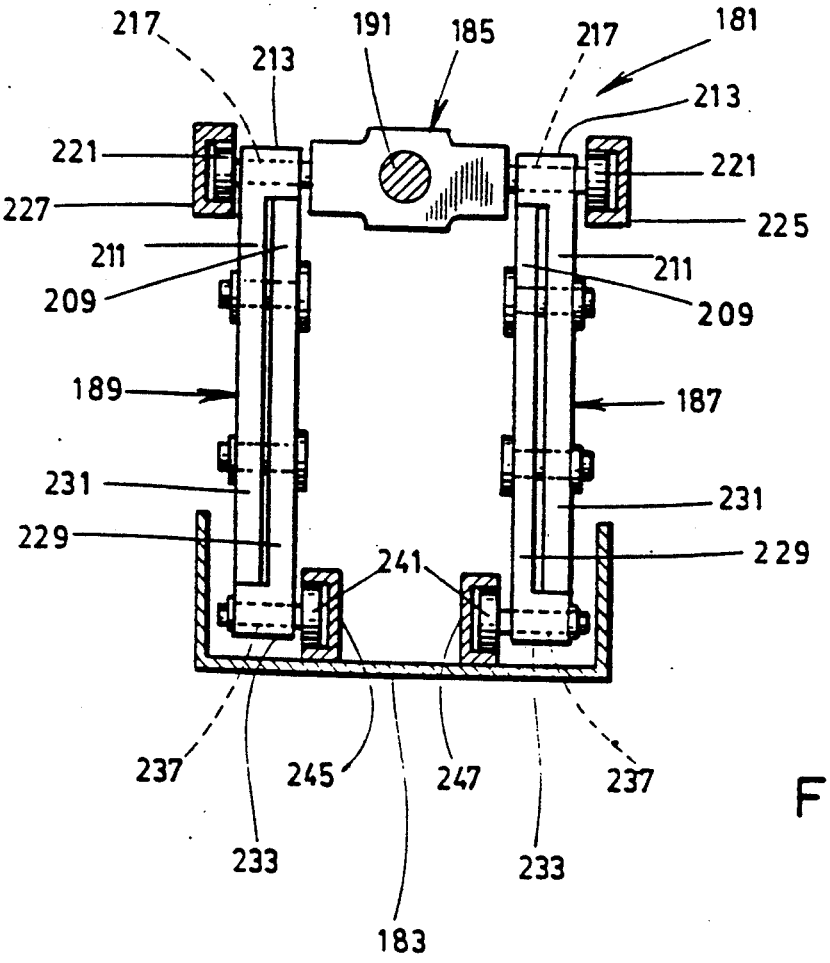
FIG. 14 is a cross-sectional view taken along of FIG. 12; line XIV—XIV
Figure 15:
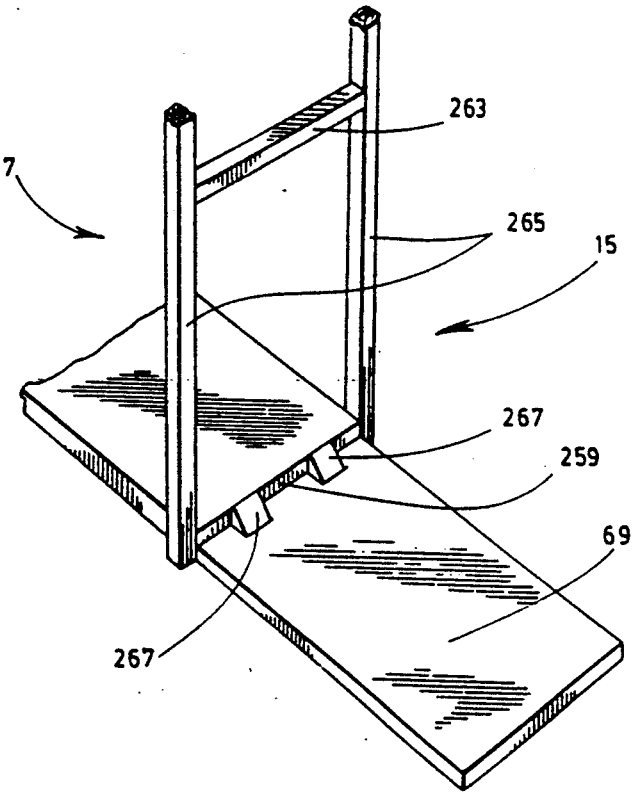
FIG. 15 is a perspective view partly torn away of the bottom and central framing structure of a compactor making use of a removable internal panel to separate the compaction compartment from the storage compartment.
Figure 16:
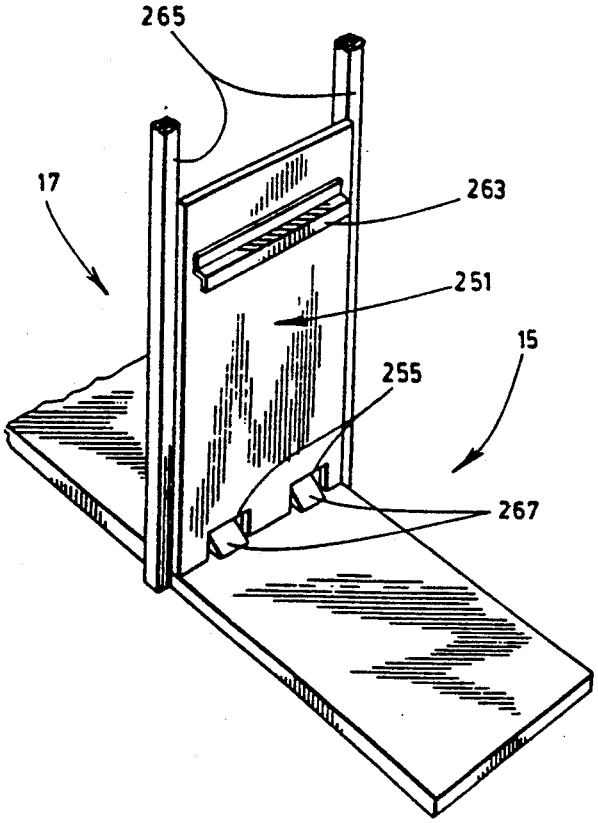
FIG. 16 is a view similar to FIG. 15, showing the internal panel in bearing position against the framing structure.

Referring now to FIGS. 12, 13 and 14, the compactor includes, in its second chamber 21, a compacting mechanism 181 which comprises a vertically movable compaction ram 183, at its lower end; a stationary drive assembly 185, at its upper end, and two expansible and contractible pantographs 187, 189, in between; connecting the ram and the drive assembly to allow vertical movement of the said ram in and out of the chamber 21 to compact refuse in a container held in the compaction chamber 15.

The drive mechanism comprises a horizontal rotary screw 191 journaled, at its ends, in suitable bearings (not shown) on two opposed structural members 193, 195, of the mechanism framework. The screw is drawn into rotation by an electric motor 197 through a chain and sprocket drive 199. It is formed of two coaxial inverted thread sections 201, 203. Two non-rotatable driving heads 205, 207, having threaded bores, are mounted respectively on the thread sections 201, 203, so that they may move relative to one another when the screw rotates. The upper ends of the upper links 209, 211, of each pantograph 187, 189, are formed with bored legs 213, 215, turned toward the driving heads 205, 207, and through which freely extend axles (frontward axles 217 only being shown in FIG. 14) of which the inner ends are secured respectively to the heads 205, 207; upper rollers 221, 223, being mounted for free rotation on their outer ends. The rollers are received and guided into pieces 225, 227, fixed to the aforesaid structural members 193, 195. In a similar manner, the lower ends of the lower links 229, 231, of each pantograph 187, 189, are formed with inwardly turned bored legs (only legs 233 being shown in FIG. 14) through which freely extend axles (axles 237 only being shown in FIG. 14) fixed to the links at one end and rotatably receiving rollers 241, 243; the latter riding in channel guides 245, 247, secured to the ram 183.

Thus, as the screw 191 is rotated by the motor 197, the driving heads 205, 207, are forced to move toward one another causing either extension or contraction of the pantographs 187, 189, depending on the sense of rotation of the screw and, consequently, rising or falling of the compaction head 183.

The embodiments of the invention in which an exclusive property or privilege is claimed are defined as follows:

1. A refuse compactor comprising:

a cabinet defining a refuse-compaction chamber and having a front wall and two opposite side walls, and a service door to give access to the compactor chamber through its front wall;

a compaction mechanism mounted in the cabinet above the compaction chamber to compact refuse in a container removeably insertable into said compaction chamber through the service door;

a pressure-resisting wall panel moveably mounted inside said compaction chamber, said wall panel being adjacent and parallel to one of said side walls of said compaction chamber;

cam means mounted inside the compaction chamber, said cam means being capable of laterally moving the wall panel toward and away from the one side wall;

actuation means mechanically connected to the cam means to operate the same in order to reversibly move the wall panel between a first position where said wall panel is rigidly held at a distance from the one side wall of the compaction chamber and a second position where said wall panel extends close to said one side wall;

said service door being pivotally mounted onto said front wall about a set of hinges;

said cam means including opposite wedges fixed on said one side wall and said wall panel respectively in such a manner as to allow bodily motion of said wall panel toward and away from said one side wall when said wall panel is shifted perpendicularly to said front wall; and said actuation means including means connecting said service door and said wall panel together to mechanically shift said wall panel perpendicularly to said front wall as soon as said service door actuated.

2. A refuse compactor as claimed in claim 1, wherein said service door and said wall panel have adjacent end edge structures and said connection means comprise a horizontal shift arm pivotally connected, at one end, to said service door end edge structure for pivotal movement about a vertical axis; and means, on said arm and on said panel end edge structure, for allowing shifting of said wall panel toward said storage chamber when said door is being closed whereby to move said wall panel away from said one side wall through said wedge means, and for allowing reverse motion of said wall panel away from said storage chamber when said door is being opened.

3. A refuse compactor as claimed in claim 2, wherein said wedge means comprise pairs of cooperating wedge blocks on said one side wall and on said wall panel.

4. A refuse compactor as claimed in claim 3, wherein said shifting means comprise:

a control plate in said end edge structure of said wall panel, said plate having an aperture through which said shift arm extends, and a first butt stop member adjustably positionable on said shift arm on one side of said control plate and a second butt stop member adjustably positionable on said arm on the other side of said control plate.

5. A refuse compactor as claimed in claim 4, further comprising return spring means in said compaction chamber and adjacent the end edge of said wall panel away from said panel end edge structure for biasing said wall panel away from said storage chamber when said service door is being opened.

6. A refuse compactor as claimed in claim 4, wherein said cabinet has a rigid frame structure and also comprises a storage chamber rearwardly of said compaction chamber, both of said compaction and storage chambers being aligned and in full communication with each other through a large opening, and wherein said compactor further comprises an internal panel detachably fixable to the refuse container prior to inserting the same into the compaction chamber, said internal panel being capable to resist compaction pressure and sized to extend across the large opening and bear against said cabinet frame structure to temporarily provide a pressure-resisting rear wall into the compaction chamber when a refuse container is inserted therein.

7. A refuse compactor as claimed in claim 4, wherein said cabinet also comprises a storage chamber rearwardly of said compaction chamber, both of said compaction and storage chambers being aligned and in full communication with each other though a large opening, and wherein said compactor further comprises a vertically displaceable compaction pressure-resisting door;

guiding means on opposite inner lateral faces of said cabinet, between said chambers, receiving and guiding said door for vertical displacement; and means for vertically slidably displacing said pressure-resisting door along said guide means between an active position wherein said door closes communication between said chambers and a retracted position wherein said communication is established, said door is made of a series of elongated horizontal slats and comprises slat hinging means joining adjacent slats together in foldable garage door fashion.

8. A refuse compactor as claimed in claim 4, wherein said service door has a framework including a pair of riser members, a horizontal top member and a horizontal bottom member joining said riser members, said service door further including a lock mechanism comprising:

lock bolts;

means mounted on said framework members, said means defining bores into which said lock bolts are slid for simultaneous movement between a retracted position thereof within said service door and a locking position thereof wherein said bolts extend partially out of said service door;

a locking handle mounted on said service door for oscillation about an axis perpendicular thereto between said positions, and a linkage assembly connecting said handle and pins and being constructed for moving said pins in unison selectively to said locking and releasing positions.

9. A refuse compactor comprising:

a cabinet defining a refuse-compaction chamber and having a front wall and two opposite side walls, and a service door to give access to the compactor chamber through its front wall;

a compaction mechanism mounted in the cabinet above the compaction chamber to compact refuse in a container removeably insertable into said compaction chamber through the service door;

a pressure-resisting wall panel moveably mounted inside said compaction chamber, said wall panel being adjacent and parallel to one of said side walls of said compaction chamber;

cam means mounted inside the compaction chamber, said cam means being capable of laterally moving the wall panel toward and away from the one side wall;

actuation means mechanically connected to the cam means to operate the same in order to reversibly move the wall panel between a first position where said wall panel is rigidly held at a distance from the one side wall of the compaction chamber and a second position where said wall panel extends close to said one side wall;

hinge means connecting said wall panel to said one side wall, said hinge means having axes perpendicular to said front wall and being so designed as to allow said wall panel to move away from said one side wall when said wall panel is shifted upwardly, and move back toward said one side wall when said wall panel is shifted downwardly;

said cam means including at least one radially extending cam mounted onto a rotatable shaft fixed under the wall panel; and said actuation means including a hand-operated lever perpendicularly projecting from said shaft to rotate the same, said lever being located in the cabinet close to the front wall thereof and being movable in a plane parallel to said front wall between an horizontal position where it extends flat over the bottom wall and a vertical position where it extends flat over the one side wall, whereby when said lever is in one of said horizontal and vertical positions, each cam on the shaft is engaged under the wall panel and keep it pushed up away from the one side wall and, when said lever is in the other of said positions, each cam is disengaged from under the wall panel which is then free to move down about its hinging means toward said one side wall, wherein said cabinet has a rigid frame structure and also comprises a storage chamber rearwardly of said compaction chamber, both of said compaction and storage chambers being aligned and in full communication with each other through an opening large enough to allow the refuse container to pass from one of said storage and compaction chambers into the other and vice verse, and wherein said compactor further comprises an internal panel detachably fixable to the refuse container prior to inserting the same into the compaction chamber, said internal panel being capable to resist compaction pressure and sized to extend across the large opening and bear against said cabinet frame wall into the compaction chamber when a refuse container is inserted therein.

10. A refuse compactor comprising:

a cabinet defining a refuse-compaction chamber and having a front wall and two opposite side walls, and a service door to give access to the compactor chamber through its front wall;

a compaction mechanism mounted in the cabinet above the compaction chamber to compact refuse in a container removeably insertable into said compaction chamber through the service door;

a pressure-resisting wall panel moveably mounted inside said compaction chamber, said wall panel being adjacent and parallel to one of said side walls of said compaction chamber;

cam means mounted inside the compaction chamber, said cam means being capable of laterally moving the wall panel toward and away from the one side wall; and actuation means mechanically connected to the cam means to operate the same in order to reversibly move the wall panel between a first position where said wall panel is rigidly held at a distance from the one side wall of the compaction chamber and a second position where said wall panel extends close to said one side wall;

hinge means connecting said wall panel to said one side wall, said hinge means having axes perpendicular to said front wall and being so designed as to allow said wall panel to move away from said one side wall when said wall panel is shifted upwardly, and move back toward said one side wall when said wall panel is shifted downwardly;

said cam means including at least one radially extending cam mounted onto a rotatable shaft fixed under the wall panel; and said actuation means including a hand-operated lever perpendicularly projecting from said shaft to rotate the same, said lever being located in the cabinet close to the front wall thereof and being movable in a plane parallel to said front wall between an horizontal position where it extends flat over the bottom wall and a vertical position where it extends flat over the one side wall;

whereby when said lever is in one of said horizontal and vertical positions, each cam on the shaft is engaged under the wall panel and keep it pushed up away from the one side wall and, when said lever is in the other of said positions, each cam is disengaged from under the wall panel which is then free to move down about its hinging means toward said one side wall;

wherein said cabinet also comprises a storage chamber rearwardly of said compaction chamber, both of said compaction and storage chambers being aligned and in full communication with each other through a large opening, and wherein said compactor further comprises:

a vertically displaceable compaction pressure-resisting door;

guiding means on opposite inner lateral faces of said cabinet, between said chambers, receiving and guiding said door for vertical displacement; and means for vertically slidably displacing said pressure-resisting door along said guide means between an active position wherein said door closes communications between said chambers and a retracted position wherein said communication is established.

11. A refuse compactor as claimed in claim 10, wherein said door is made of a series of elongated horizontal slats and comprises slat hinging means joining adjacent slats together in foldable garage door fashion.

12. A refuse compactor as claimed in claim 11, wherein:

said cabinet further has a first remote chamber above said storage chamber; and said door displacing means are mounted in said remote chamber; and wherein said door displacing means comprises:

an upwardly extending rotary screw in said remote chamber;

a lifting strap having one end threaded on said screw for movement therealong when said screw rotates;

a link pivotally joining the other end of said strap and the top one of said door slats; and whereby rotation of said screw causes said door to be displaced between said door active position, intermediate said compaction and storage chambers, and said retracted position wherein it lies in said remote chamber.

13. A refuse compactor comprising:

a cabinet defining a refuse-compaction chamber and having a front wall and two opposite side walls, and a service door to give access to the compactor chamber through its front wall;

a compaction mechanism mounted in the cabinet above the compaction chamber to compact refuse in a container removeably insertable into said compaction chamber through the service door;

a pressure-resisting wall panel moveably mounted inside said compaction chamber, said wall panel being adjacent and parallel to one of said side walls of said compaction chamber;

cam means mounted inside the compaction chamber, said cam means being capable of laterally moving the wall panel toward and away from the one side wall;

actuation means mechanically connected to the cam means to operate the same in order to reversibly move the wall panel between a first position where said wall panel is rigidly held at a distance from the one side wall of the compaction chamber and a second position where said wall panel extends close to said one side wall;

hinge means connecting said wall panel to said one side wall, said hinge means having axes perpendicular to said front wall and being so designed as to allow said wall panel to move away from said one side wall when said wall panel is shifted upwardly, and move back toward said one side wall when said wall panel is shifted downwardly;

said cam means including at least one radially extending cam mounted onto a rotatable shaft fixed under the wall panel; and said actuation means including a hand-operated lever perpendicularly projecting from said shaft to rotate the same, said lever being located in the cabinet close to the front wall thereof and being movable in a plane parallel to said front wall between an horizontal position where it extends flat over the bottom wall and a vertical position where it extends flat over the one side wall;

whereby when said lever is in one of said horizontal and vertical positions, each cam on the shaft is engaged under the wall panel and keep it pushed up away from the one side wall and, when said lever is in the other of said positions, each cam is disengaged from under the wall panel which is then free to move down about its hinging means toward said one side wall;

wherein said service door has a framework including a pair of riser members, a horizontal top member and a horizontal bottom member joining said riser members, said service door further including a lock mechanism comprising:

lock bolts;

means mounted on said framework members, said means defining bores into which said lock bolts are slid for simultaneous movement between a retracted position thereof within said service door and a locking position thereof wherein said bolts extend partially out of said service door;

a locking handle mounted on said service door for oscillation about an axis perpendicular thereto between said position; and a linkage assembly connecting said handle and pins and being constructed for moving said pins in unison selectively to said locking and releasing positions.

14. A refuse compactor as claimed in claim 13, wherein said lock bolts move respectively through said riser, said top and bottom members, and said bore defining means; wherein said locking handle is a bell-crank lever having a pair of angularly disposed actuating arms, and wherein said linkage assembly comprises:

a first movement-transmitting bell-crank lever having a pair of transmitting arms; said lever being mounted on said service door for oscillation about an axis perpendicular thereto;

a first rod pivoted, at the ends thereof, respectively to one of said actuating arms and to one of said transmitting arms;

a second rod pivoted, at the ends thereof, respectively to the other of said transmitting arms and to said top member lock bolt;

means pivoting the inward end of said riser member lock bolt to said one of said transmitting arms, and a third rod pivoted, at the ends thereof, respectively to the other of said actuating arms and to said bottom member lock bolt.

15. A refuse compactor as claimed in claim 14, wherein said lock mechanism further comprises:

a second riser member lock bolt and a further riser bore-defining means slidably receiving said second riser lock bolt beneath the first riser lock bolt aforesaid;

a second movement-transmitting bell-crank lever having a pair of transmitting arms of which one arm is pivoted to the end of said third rod away from said other of said actuating arms, and a fourth rod pivoted, at the ends thereof, respectively to said second riser-member lock bolt and to the other of said transmitting arms of said second bell-crank lever.

16. A refuse compactor as claimed in claim 13, wherein said cabinet further has a remote chamber above said compaction chamber and in communication therewith and wherein said compaction mechanism is mounted in said remote chamber and comprises a compaction ram;

a horizontally disposed rotary screw, said screw having a pair of coaxial inverted thread sections;

a pair of non-rotatable driving heads, each threadedly mounted on one of said thread sections so as to move relative to one another when said screw rotates;

a pair of pantographs, one on either side of said screw, each pantograph having a pair of upper links ends and a pair of lower links ends;

a pair of upper guide members parallel to said rotary screw and fixed to said cabinet;

a vertically displaceable ram having a pair of lower guide members parallel to said rotary screw;

upper and lower rollers freely mounted in said upper and lower guide members, respectively;

upper support axles simultaneously connecting said upper rollers and said links upper ends to said driving heads to be displaced thereby as said screw is rotated;

lower support axles interconnecting said lower rollers and said links lower ends; and whereby, as said screw rotates, said driving heads move lengthwise thereof and cause said pantagraphs to expand and contract thereby moving said ram in and out of said compaction chamber.

17. A refuse compactor as claimed in claim 16, wherein said compaction mechanism further comprises electric motor means, in said second remote chamber, operatively connected to said screw for rotating said screw.

* * * * *